US011873142B2

(12) United States Patent
Marino et al.

(10) Patent No.: US 11,873,142 B2
(45) Date of Patent: Jan. 16, 2024

(54) STORAGE CONTAINER SYSTEMS INCLUDING CONTAINERS AND CORRESPONDING LIDS

(71) Applicant: S.C. Johnson & Son, Inc., Racine, WI (US)

(72) Inventors: Samuel J. Marino, Oak Creek, WI (US); Kasey A. Fuller, Freeland, MI (US); Amy P. Goldsmith, Saint Francis, WI (US); Brian T. Davis, Burlington, WI (US); Pierce J. Peterson, Oregon, WI (US); Michael T. Robl, Marvin, WI (US); Donald E. McCumber, Madison, WI (US)

(73) Assignee: S.C. Johnson & Son, Inc., Racine, WI (US)

( * ) Notice: Subject to any disclaimer, the term of this patent is extended or adjusted under 35 U.S.C. 154(b) by 0 days.

(21) Appl. No.: 16/918,244

(22) Filed: Jul. 1, 2020

(65) Prior Publication Data

US 2021/0002037 A1 Jan. 7, 2021

Related U.S. Application Data

(60) Provisional application No. 62/870,927, filed on Jul. 5, 2019.

(51) Int. Cl.
*B65D 43/02* (2006.01)
*B65D 1/24* (2006.01)

(52) U.S. Cl.
CPC ..... *B65D 43/0208* (2013.01); *B65D 1/24* (2013.01); *B65D 2543/005* (2013.01);
(Continued)

(58) Field of Classification Search
CPC ..... B65D 43/0208; B65D 43/021; B65D 43/0206; B65D 1/24; B65D 2543/00194
See application file for complete search history.

(56) References Cited

U.S. PATENT DOCUMENTS 3,447,714 A 6/1969 Elliot
3,460,711 A 8/1969 Al-Roy
(Continued)

FOREIGN PATENT DOCUMENTS

EP 1900647 A 9/2008
JP S59-13465 U 1/1984
(Continued)

OTHER PUBLICATIONS

International Search Report and Written Opinion dated Sep. 22, 2020, issued in corresponding International Application No. PCT/US2020/040650.
(Continued)

*Primary Examiner* — Jeffrey R Allen

(57) ABSTRACT

A container system includes a container having a plurality of sidewalls and a rim extending from the sidewalls at a top of the container. The rim of the container includes a first sealing part and a second sealing part. Parts of the rim extend along arcs as viewed from above the container. The container system also includes a lid for sealing the container, with the lid having a rim that includes a first sealing part that is configured to contact the first sealing part of the rim of the container to form a first sealing area, and a second sealing part that is configured to contact the second sealing part of the rim of the container to form a second sealing area. Parts of the rim of the lid extend along arcs as viewed from above the lid. The container may be tightly sealed by the lid.

11 Claims, 17 Drawing Sheets

(52) U.S. Cl.
CPC ..... *B65D 2543/00194* (2013.01); *B65D 2543/00203* (2013.01); *B65D 2543/00296* (2013.01); *B65D 2543/00537* (2013.01); *B65D 2543/00555* (2013.01); *B65D 2543/00694* (2013.01); *B65D 2543/00805* (2013.01); *B65D 2543/00833* (2013.01)

(56) References Cited

U.S. PATENT DOCUMENTS

| | | | | |
|---|---|---|---|---|
| 4,679,699 | A | 6/1987 | Malsbury et al. | |
| 6,170,696 | B1 | 1/2001 | Tucker et al. | |
| 6,467,647 | B1 | 10/2002 | Tucker et al. | |
| 6,672,473 | B2 | 1/2004 | Torniainen et al. | |
| 6,910,599 | B2 | 6/2005 | Tucker et al. | |
| 7,063,231 | B2 | 6/2006 | Stanos et al. | |
| 7,261,219 | B2 | 8/2007 | Tucker et al. | |
| 8,083,095 | B2 | 12/2011 | Tucker et al. | |
| 8,091,732 | B2 * | 1/2012 | Bryson | B65D 43/0208 220/780 |
| 8,267,278 | B2 | 9/2012 | Tucker et al. | |
| 2007/0007298 | A1 | 1/2007 | Tucker et al. | |
| 2008/0041850 | A1 * | 2/2008 | Tucker | B65D 21/0222 220/212 |
| 2008/0118609 | A1 | 5/2008 | Harlfinger | |
| 2011/0215024 | A1 | 9/2011 | Pomfrey | |
| 2011/0315702 | A1 | 12/2011 | Leboeuf et al. | |
| 2015/0021321 | A1 | 1/2015 | Gosen et al. | |

FOREIGN PATENT DOCUMENTS

| | | | |
|---|---|---|---|
| JP | 2004-075123 | A | 3/2004 |
| JP | 2008-531412 | A | 8/2008 |
| WO | 2005/000699 | A2 | 1/2005 |
| WO | 2005/00699 | A2 | 8/2006 |
| WO | 2006/091471 | A2 | 8/2006 |

OTHER PUBLICATIONS

Glad Gladware Entree Plastic Square Containers with Lids, 25 Ounce, 5 Count, Amazon.com (accessed Jul. 2, 2019).

Japanese Office Action dated Jan. 4, 2023, in corresponding Japanese Application No. 2021-568837, with English translation (9 pages).

Japanese Office Action dated Jul. 4, 2023, in corresponding Japanese Application No. 2021-568837, with English translation (11 pages).

* cited by examiner

STORAGE CONTAINER SYSTEMS INCLUDING CONTAINERS AND CORRESPONDING LIDS

BACKGROUND

Field of the Invention

Our invention relates to plastic storage container systems. More particularly, our invention relates to plastic storage containers and lids that are easy to use, for example, as an on-the-go food storage solution.

Related Art

Plastic storage container systems are functional in many ways. For example, plastic containers can be used to store small objects in closets or tools in garages. As another example, plastic containers can be used to store food in a refrigerator or cupboard. In fact, there is an increasing demand for plastic container storage systems that can store food "on-the-go." Such systems can be used by adults taking lunches to workplaces, and by children bringing their lunches to school. Examples of plastic storage systems are sold under the trademark ZIPLOC® by S.C. Johnson & Son, Inc. (the assignee of the invention described herein) of Racine, Wis.

When using a plastic storage container for on-the-go food storage, there is the potential for liquid contents to leak when the container is agitated, shaken, etc. Thus, there is a need for plastic storage container systems with effective sealing mechanisms. Indeed, from a user's viewpoint, the ability to securely seal the plastic storage system is often one of the most important features of the system.

It is also desirable that the sealing mechanism have other attributes in addition to the ability to provide a secure seal for the container system. For example, it should be relatively easy for a user to engage and disengage the seal. This involves considerations of how easy/difficult it is for the user to correctly align the lid and the corresponding container, as well as how much force is required for the lid to be brought into sealing engagement with the container. The sealing structures on the lid and container that engage each other should also maintain their shape through many uses of the storage system. Sealing structures can be deformed, for example, when the storage system is cleaned in an automatic dishwasher. Yet another good attribute of a sealing mechanism is the ability to provide the user with confidence that the lid and the container are actually sealed and that the seal will be maintained; if a consumer does not trust that a storage system will be sealed and stay sealed, then the consumer is less likely to use the system.

Examples of plastic storage container systems that can be used to store food are disclosed in U.S. Pat. No. 9,108,766, which is incorporated herein by reference in its entirety. This publication describes, among other things, container systems that include a container and corresponding lid provided with a double seal mechanism having two regions of contact between a rim of the container and a rim of the lid.

SUMMARY OF THE INVENTION

According to one aspect, our invention provides a container system including a container having a plurality of sidewalls and a rim extending from the sidewalls at a top of the container. The rim of the container includes a first sealing part and a second sealing part, with the first sealing part and the second sealing part being located on surfaces of the rim that face the inside of the container, and parts of the rim extending along arcs as viewed from above the container. The container system also includes a lid for sealing the container, with the lid having a rim that extends along sides of the lid. The rim of the lid includes a first sealing part that is configured to contact the first sealing part of the rim of the container to form a first sealing area, and a second sealing part that is configured to contact the second sealing part of the rim of the container to form a second sealing area. Parts of the rim of the lid extend along arcs as viewed from above the lid. Further, the first contact area and the second contact area are offset in a vertical direction.

According to another aspect, our invention provides a container system including a container having a plurality of sidewalls and a rim extending from the sidewalls at a top of the container. The rim of the container includes a first sealing part and a second sealing part, with the first sealing part and the second sealing part being located on surfaces of the rim that face the inside of the container, and with a plurality of protuberances being formed in the rim. Parts of the rim extend along arcs as viewed from above the container. The container system also includes a lid for closing the top of the container, with the lid having a rim that extends along sides of the lid. The rim of the lid includes (i) a first sealing part that is configured to contact the first sealing part of the rim of the container to form a first sealing area, and (ii) a second sealing part that is configured to contact the second sealing part of the rim of the container to form a second sealing area, with a plurality of protuberances being formed in the lid. Parts of the rim of the lid extend along arcs as viewed from above the lid. The protuberances of the rim of the container are positioned to align with the protuberances of the lid when the lid is sealed to the container.

According to another aspect, our invention provides a container system that includes a plurality of containers each having a different volume, each container including a plurality of sidewalls and a rim extending from the sidewalls at a top of the container, the rim of each container including a first sealing part and a second sealing part. The first sealing part and the second sealing part are located on surfaces of the rim that face the inside of the container, and a plurality of protuberances are formed in the rims. Parts of the rims extend along arcs as viewed from above the containers. The container system also includes a plurality of lids for closing the tops of the containers. Each lid has a rim that extends along sides of the lid, with the rim of the lid including (i) a first sealing part that is configured to contact the first sealing part of the rim of the container to form a first sealing area, and (ii) a second sealing part that is configured to contact the second sealing part of the rim of the container to form a second sealing area. A plurality of protuberances is formed in each of the lids. Parts of the rims of the lids extend along arcs as viewed from above the lids. The protuberances of each of the rims of the lids are positioned to align with the protuberances of at least one of the containers when the lids are sealed to corresponding containers.

DETAILED DESCRIPTION OF THE INVENTION

Our invention relates to container systems that include containers and corresponding lids for sealing the containers. The container systems can be made from a variety of materials, and in particular, plastics. The container systems can be used to store many different types of objects, including both food and non-food items. The containers are highly portable, and therefore may be useful, for example, as "on-the-go" food storage. Note, as used herein, a "container system" denotes at least one container and corresponding lid for sealing the container, but may also include multiple container and lid combinations, for example, as described in the aforementioned U.S. Pat. No. 9,108,766.

FIGS. 1A-9D show views of containers and corresponding lids according to embodiments of our invention. As will be appreciated from the figures and the disclosure herein, the containers and lids can be made in different shapes and sizes. Accordingly, our invention should not be construed as limited to the designs shown in the embodiments depicted in any of the figures. Similarly, it should be noted that our invention is not limited to the aesthetic designs of the containers and lids shown in the figures, e.g., the functionalities described herein can be achieved with aesthetic designs that are different from those shown in the figures.

Figure 1B:
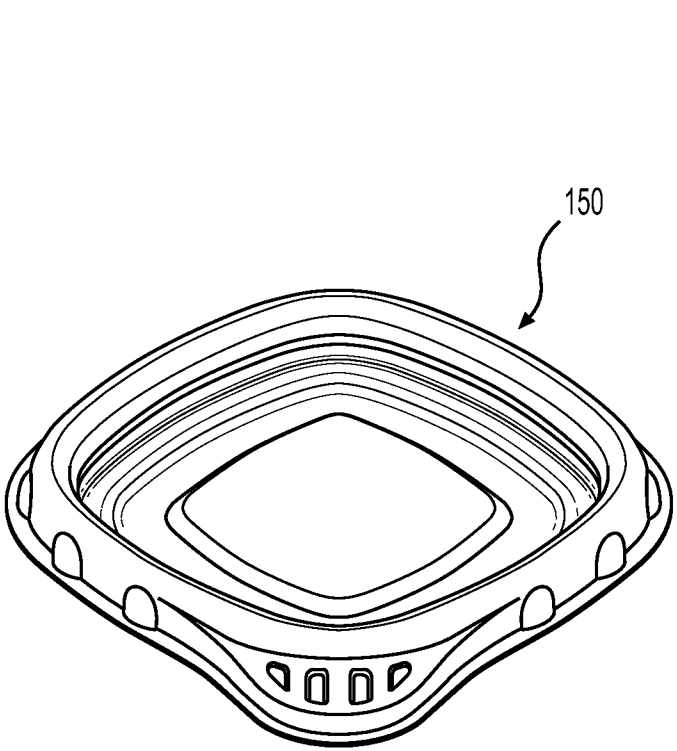
FIGS. 1A-1C are views of a lid for a container according to an embodiment of our invention.
Figure 1A:
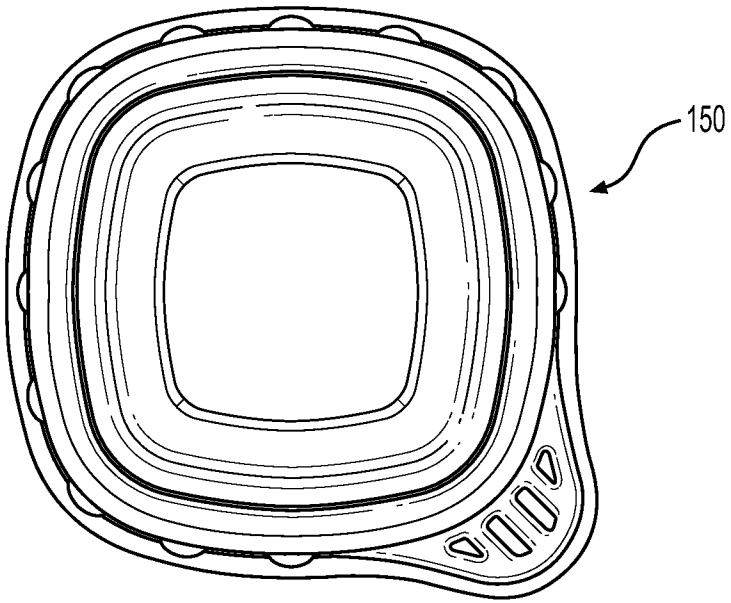
Figure 1C:
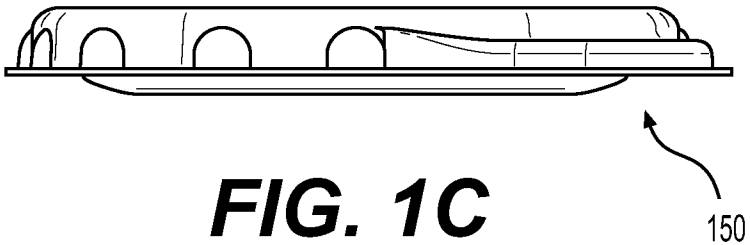
Figure 1E:
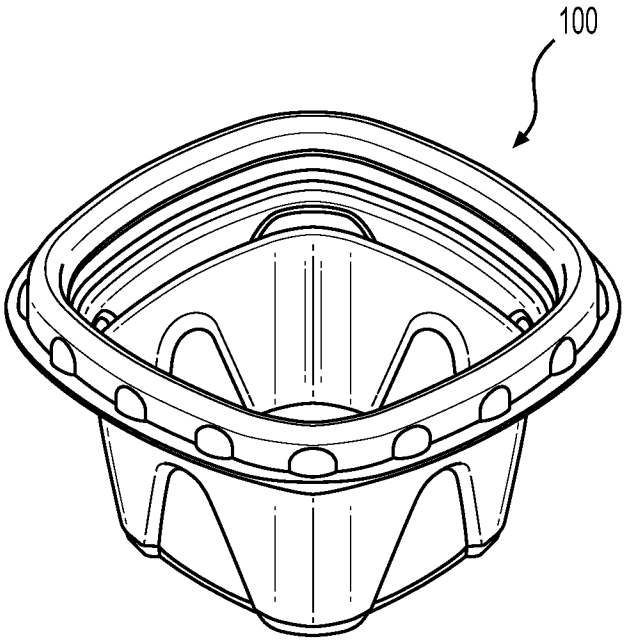
FIGS. 1D-1F are views of a container that corresponds to the lid shown in FIGS. 1A-1C.
Figure 1D:
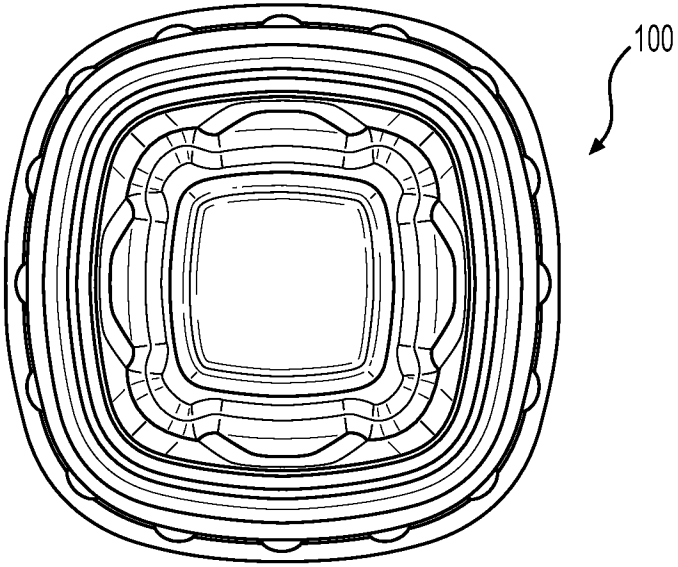
Figure 1F:
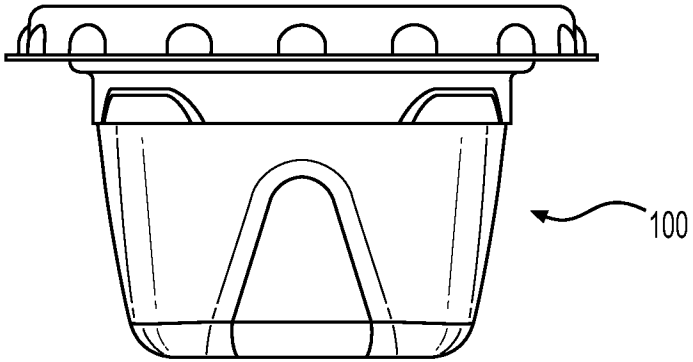

FIGS. 1A-1C show views of a lid 150 for a container 100 shown in FIGS. 1D-1E. The container 100 has a generally square shape and may have a storage volume, for example, of about 0.5 cups.

Figure 2A:
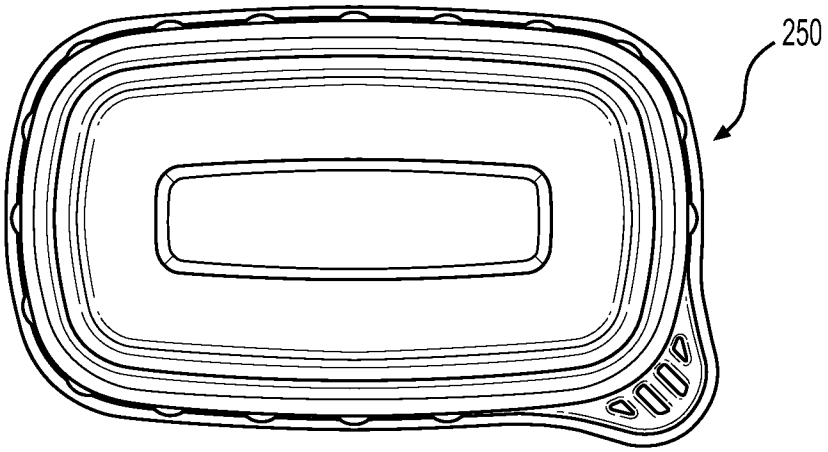
FIGS. 2A-2C are views of a lid for a container according to another embodiment of our invention.
Figure 2B:
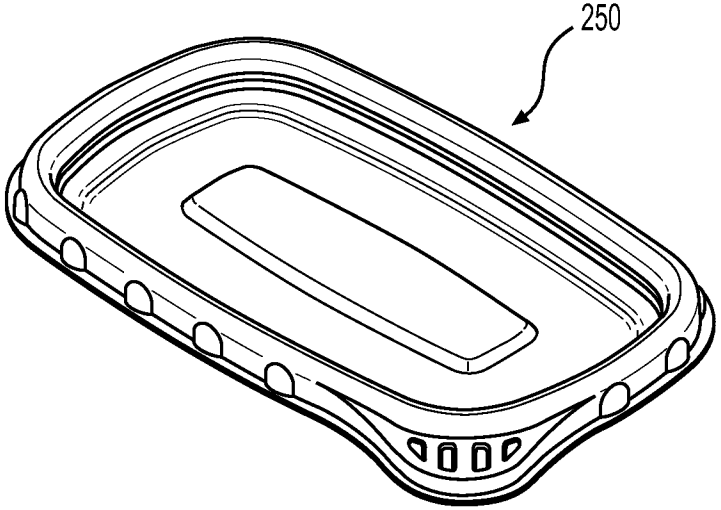
Figure 2C:
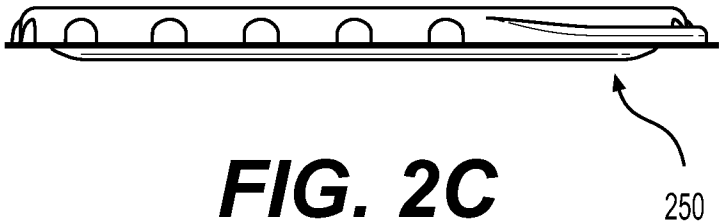
Figure 2E:
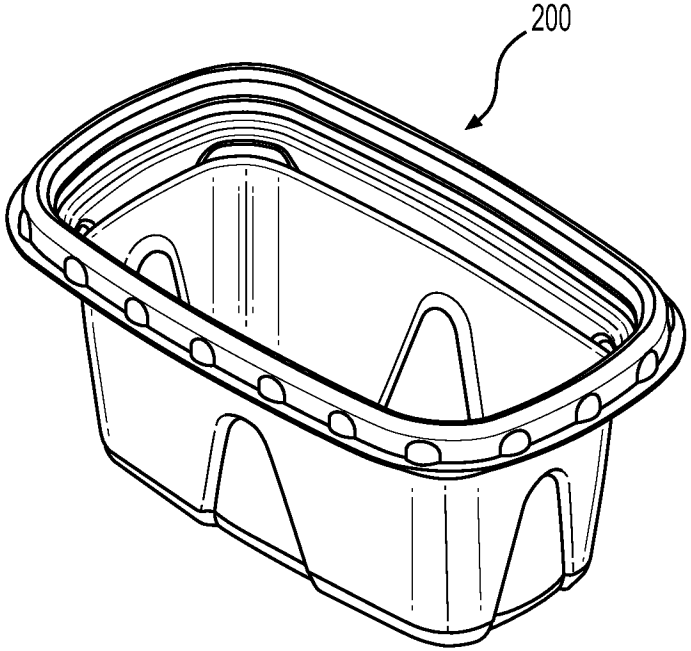
FIGS. 2D-2F are views of a container that corresponds to the lid shown in FIGS. 2A-2C.
Figure 2D:
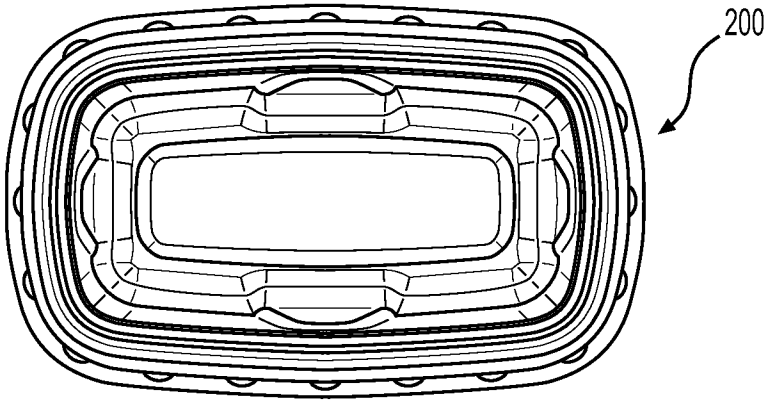
Figure 2F:
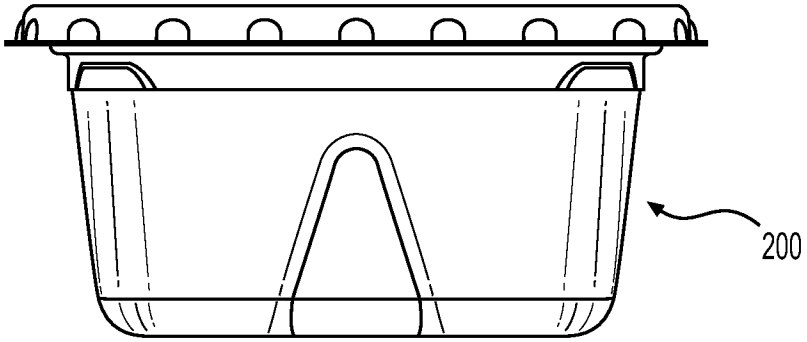

FIGS. 2A-2C show views of a lid 250 for a container 200 shown in FIGS. 2D-2E. The container 200 has a generally rectangular shape with a storage volume of about 1.5 cups.

Figure 3A:
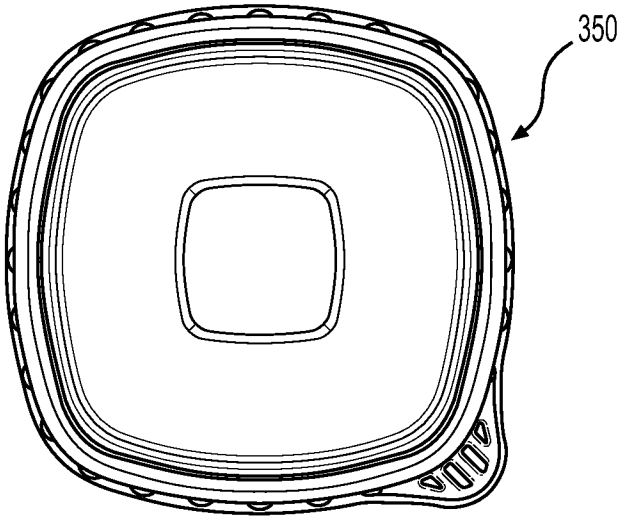
FIGS. 3A-3C are views of a lid for a container according to a further embodiment of our invention.
Figure 3B:
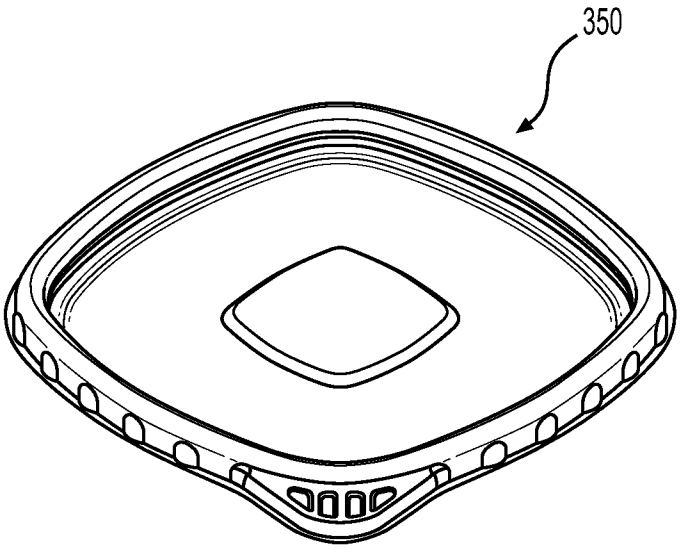
Figure 3C:
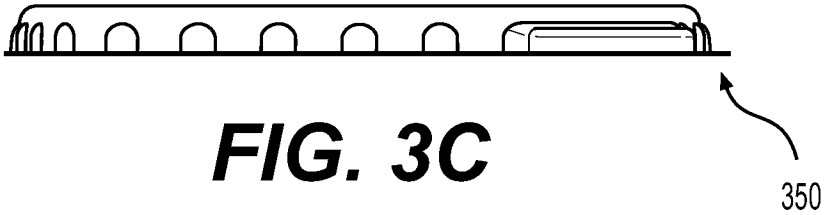
Figure 4B:
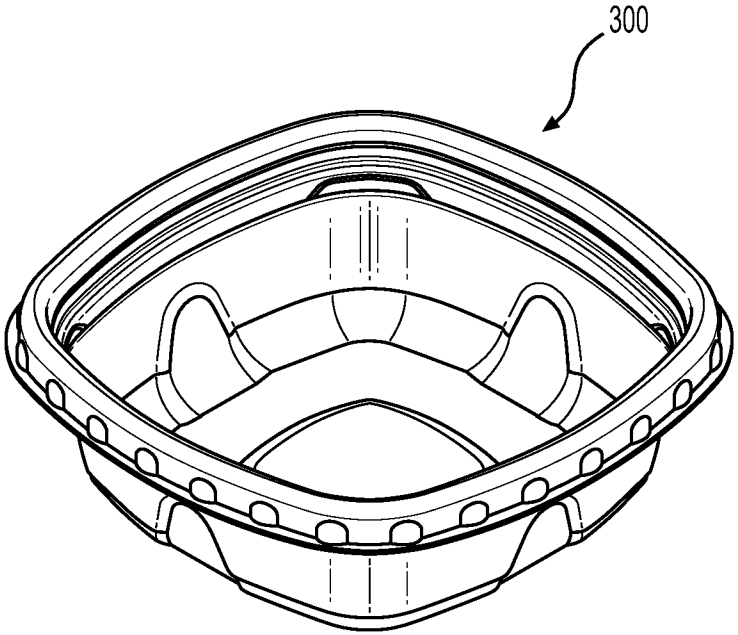
FIGS. 4A-4C are views of a container that corresponds to the lid shown in FIGS. 3A-3C.
Figure 4A:
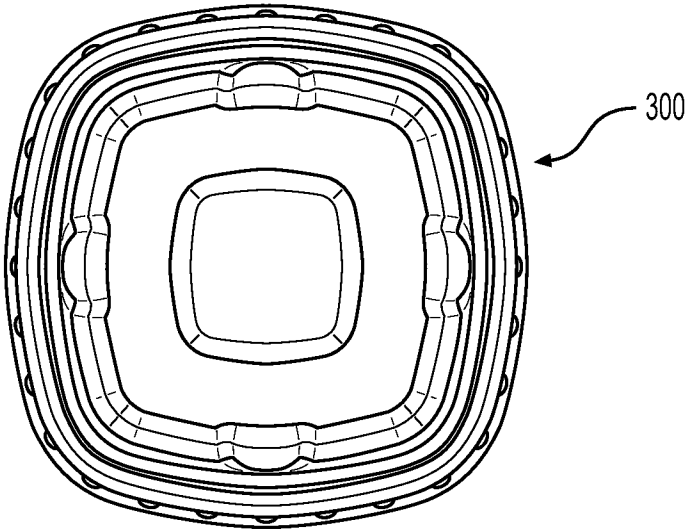
Figure 4C:
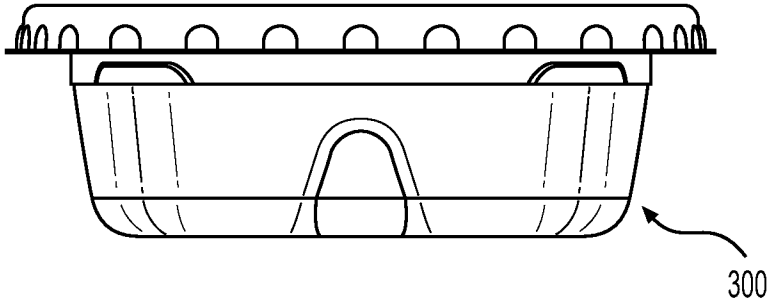
Figure 5B:
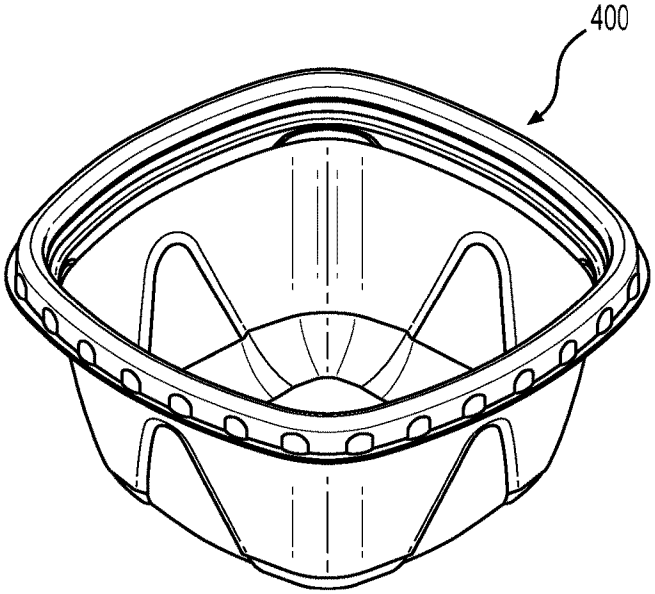
FIGS. 5A-5C are views of another container that corresponds to the lid shown in FIGS. 3A-3C.
Figure 5A:
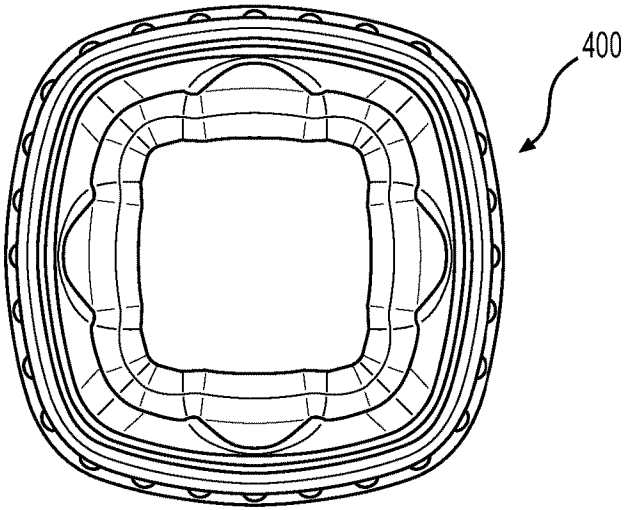
Figure 5C:
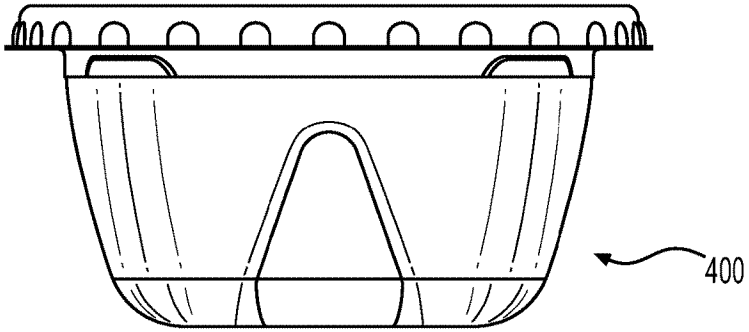
Figure 6A:
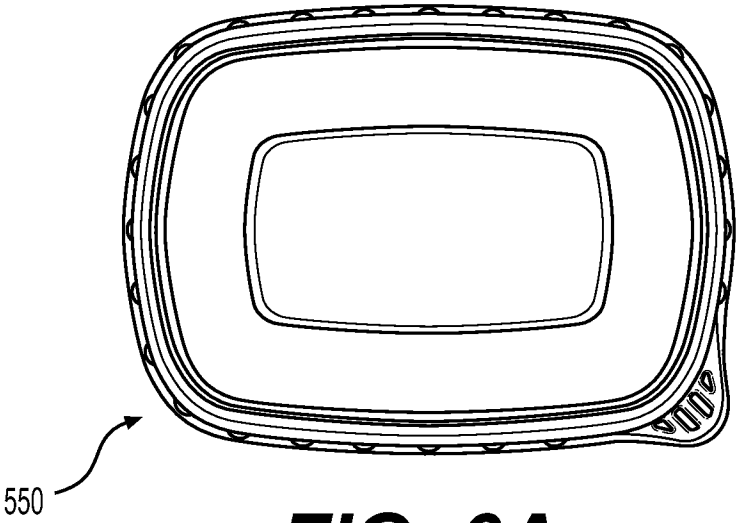
FIGS. 6A-6D are views of a lid for a container according to another embodiment of our invention.
Figure 6B:
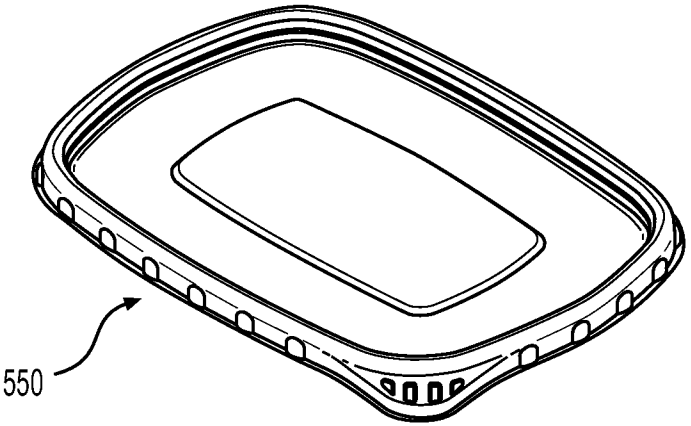
Figure 6C:
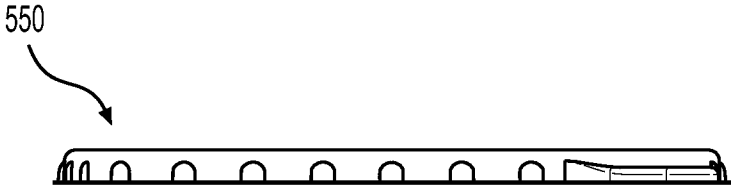
Figure 6D:
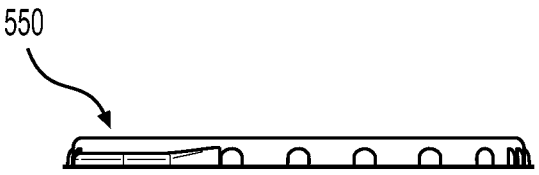
Figure 7B:
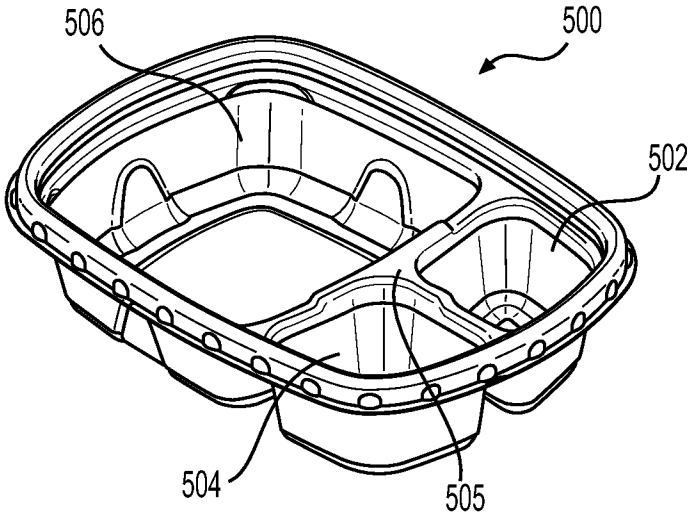
FIGS. 7A-7D are views of a container that corresponds to the lid shown in FIGS. 6A-6C.
Figure 7D:
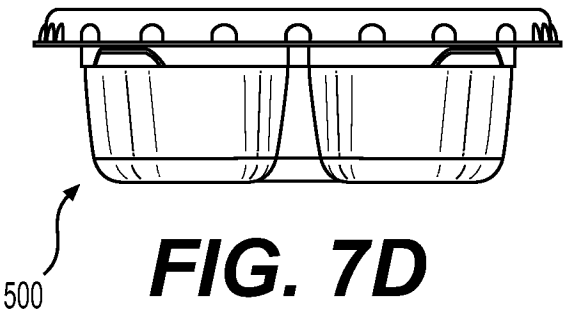
Figure 7A:
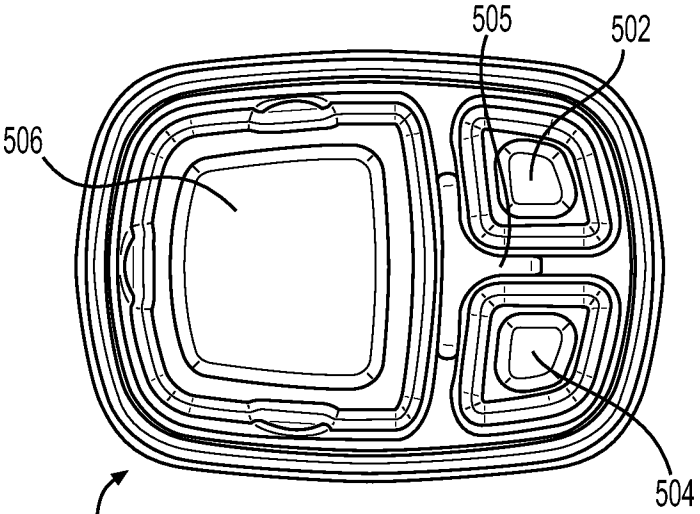
Figure 7C:
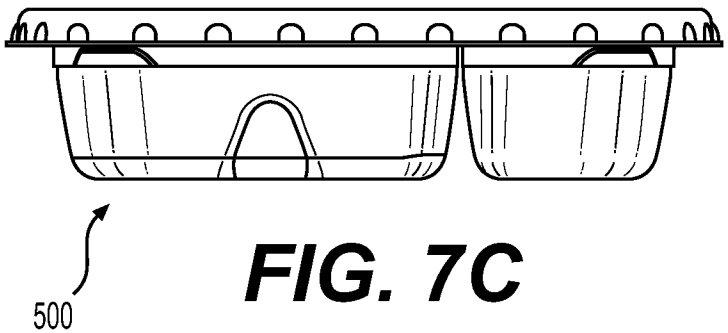

FIGS. 3A-3C show views of a lid 350 that fits both the container 300 shown in FIGS. 4A-4C and the container 400 shown in FIGS. 5A-5C. The container 300 has a generally square shape with a storage volume of about 3 cups. The container 400 also has a generally square shape, but has a storage volume of about 5 cups. As also shown in FIGS. 4B, 4C, 5B, and 5C, measurement markers can be provided at corners of the containers 300 and 400. When the containers 300 and 400 are filled with materials such as a liquid or powder, the measurement markers mimic the visual appearance of a common measuring cup.

FIGS. 6A-6D show views of a lid 550 that fits the containers 500, 600, and 700, shown in FIGS. 7A-7D, 8A-8C, and 9A-9D, respectively. The container 500 shown in FIGS. 7A-7D is generally rectangular in shape. The interior of container 500 is divided into three distinct storage spaces 502, 504, and 506. In total, the container 500 has a storage volume of about 4 cups. Also, a raised barrier 505 is provided at the top of the walls defining the distinct storage spaces 502, 504, and 506. The barrier 505 functions as a visual cue for a user. Further, an indentation can also be provided in the lid 550 as a visual cue corresponding to the barrier 505.

Figure 8B:
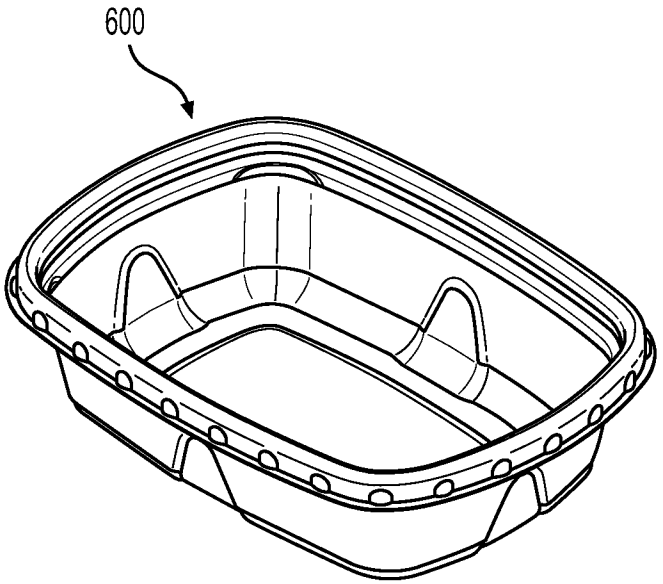
FIGS. 8A-8C are views of another container that corresponds to the lid shown in FIGS. 6A-6C.
Figure 8A:
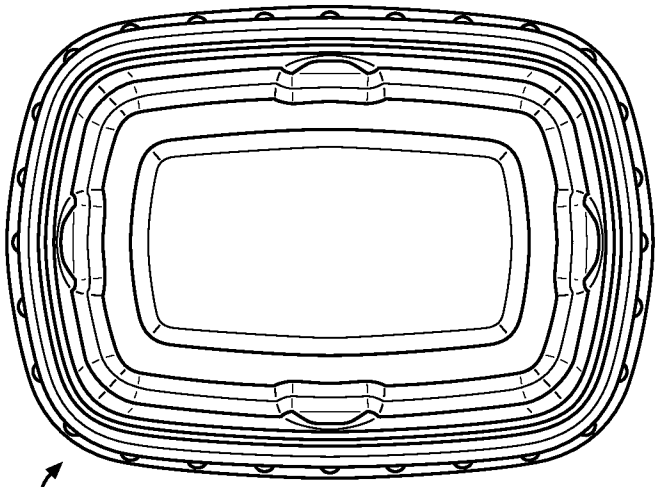
Figure 8C:
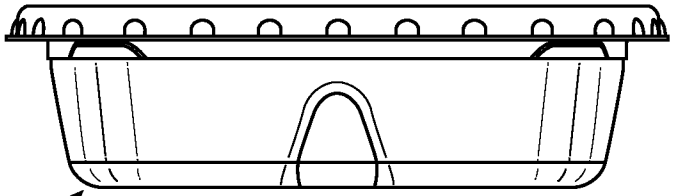
Figure 9B:
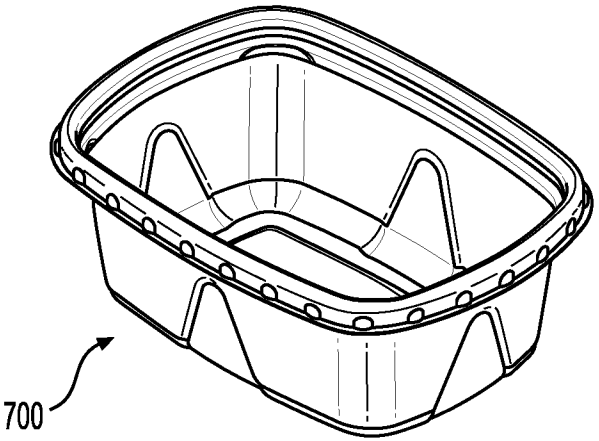
FIGS. 9A-9D are views of a further container that corresponds to the lid shown in FIGS. 6A-6C.
Figure 9D:
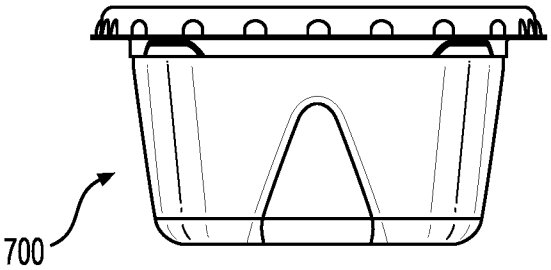
Figure 9A:
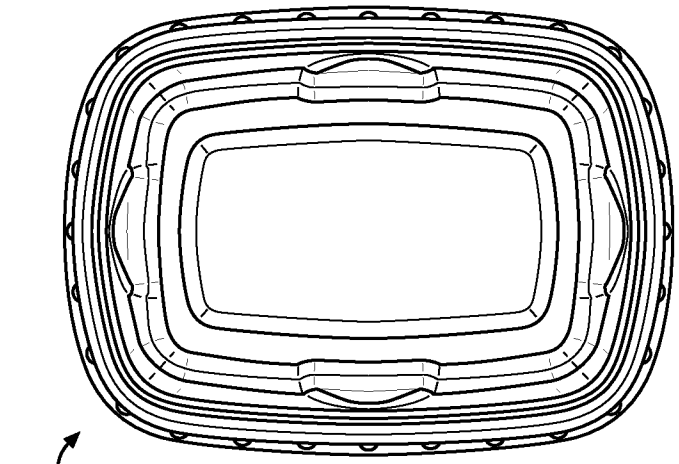
Figure 9C:
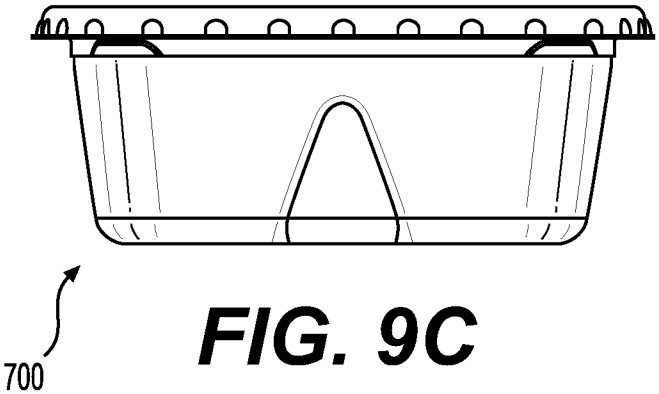

The container 600 shown in FIGS. 8A-8C has a generally rectangular shape, and has a storage volume of about 6 cups, while the container 700 shown in FIGS. 9A-9D also has a generally rectangular shape, but has a storage volume of about 9 cups.

Those skilled in the art will easily recognize the numerous alternative configurations for the container systems shown in FIGS. 1A-9D. For example, the interior spaces of any of the containers might be divided into distinct storage spaces similar to the way that the container 500 is divided into three distinct storage spaces 502, 504, and 506. Moreover, the containers and corresponding lids could be formed in different shapes, such as round or triangular shapes.

The containers and lids of our invention can be manufactured using well-known techniques, including, for example, thermoforming, injection molding, or vacuum molding. Further, the containers and lids can be formed from a wide variety of well-known polymeric materials, including, for example, low density polyethylene (LDPE), linear low-density polyethylene (LLDPE), high density polyethylene (HDPE), polystyrene, crystalline polyethylene terephthalate, amorphous polyethylene terephthalate, polyvinyl chloride, polycarbonate, polypropylene, and post-consumer recycled (PCR) material/combinations thereof. As will be appreciated by those skilled in the art, with such materials the containers and lids can be made in a wide range of transparencies and/or colors.

Figure 10B:
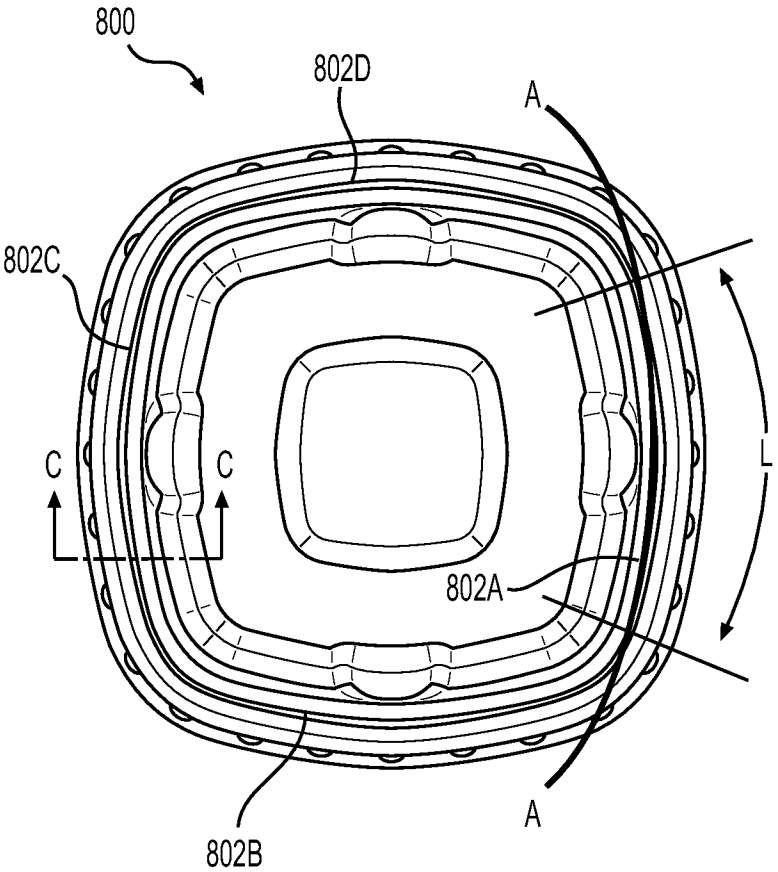
FIGS. 10A and 10B are top views of a container according to a further embodiment of our invention.
Figure 10A:
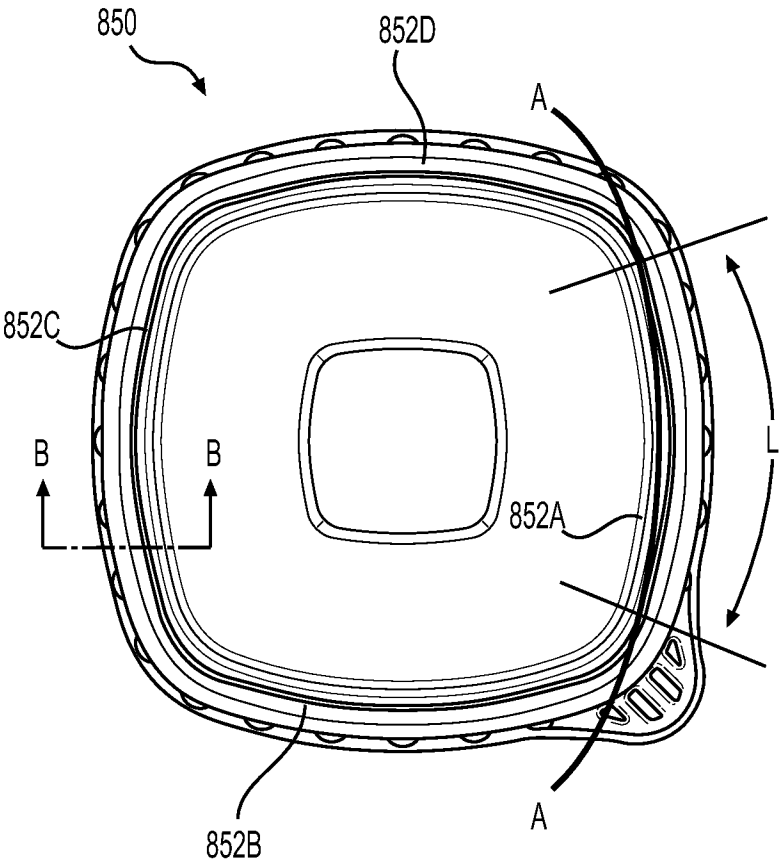

FIGS. 10A and 10B show top views of a container 800 and a lid 850 according to further embodiments of our invention. As can be readily seen in these figures, the parts 802A, 802B, 802C, and 802D of the rim extending from the sidewalls of the container 800 and the corresponding parts 852A, 852B, 852C, and 852D of the rim of the lid 850 have a rounded/arced shape. That is, as viewed from above, the parts 802A, 802B, 802C, 802D of the rim of the container 800 and the parts 852A, 852B, 852C, and 852D of the rim of the lid, extend along the arcs A-A shown in the figures.

Without being bound by theory, we believe that the rounded parts of the rims of the container 800 and the lid 850 improve the seal that is formed in the container system by reducing (if not completely eliminating) the formation of gaps in the areas where the rims of the container 800 and lid 850 contact each other to form a seal. In conventional plastic storage systems, when the sealing areas of a container and lid are initially molded or thermoformed to extend along generally straight lines, the sealing areas may shrink during the subsequent cooling process. Further, the container system may be subject to conditions and/or environments that cause shrinkage or other distortions in the sealing areas during ordinary use of the system. For example, the conditions inside an automatic dishwasher may cause the sealing rim of the container to cave inwards, and this distortion may increase as the container is washed many times. We believe that shrinkage or other distortions occurring in the sealing areas of a container and/or lid may cause the formation of gaps in the sealing surfaces and thereby compromise the integrity of points of contact that create the seal. However, the rounded parts of the sealing rims of the containers and lids in embodiments of our invention have the effect of reducing shrinkage or other distortions. For example, the rounded shapes of the rims of the containers and the lids increase the hoop strengths of the rims in comparison to straight rims of otherwise similar containers and lids. The added hoop strength resists forces that cause shrinkage or distortion in the rims of the containers and lids.

As will be appreciated by those skilled in the art, an arc can be characterized by the radius of a circle that includes the arc. That is, a radius of the arc is equivalent to the radius of a circle that includes the arc. We have found that particular relationships between the radii of the arcs of the rounded parts of the sealing rims of containers and lids to the length along the rounded rims provide surprisingly good effects in terms of reducing the shrinkage and other distortions of the rims that can reduce the effectiveness of a seal. Specifically, we have found that if the arcs along the rounded rims of the container and lid have radii of about 1 to about 2.5 times the length along the arcs along rounded rims, then the rims of the containers and lids are particularly resistant to shrinkage or other distortions. For example, in FIGS. 10A and 10B, when the length L of the arcs along the parts of the rims 802A and 852A are about 3 inches, 6 inch radii of the arcs A-A will provide excellent resistance to shrinkage and distortion of the sides.

We have also found that there is a relation between the volume of a container and a minimal ideal radius of the arcs A-A along the parts of the rim of the container that can be used to achieve significant shrinkage and distortion resistance. Specifically, for containers having volumes of less than 1 cup, a minimal ideal radius is about 0.25 in. For containers having volumes between 1-2 cups, a minimal ideal radius is about 0.375 in. And, for containers having volumes between 3-9 cups, a minimal ideal radius is about 0.5 in.

It should also be noted that, with its rounded rim, the container 800 design shown in FIG. 10B has smooth, round corners. Such corners allow for easy cleaning of the container 800 by reducing hard to reach spots in the corners. And, when the container 800 is used to hold food, utensils can easily reach into the smooth corners, and food particles can easily be removed from the smooth corners when the container 800 is cleaned.

Figure 11:
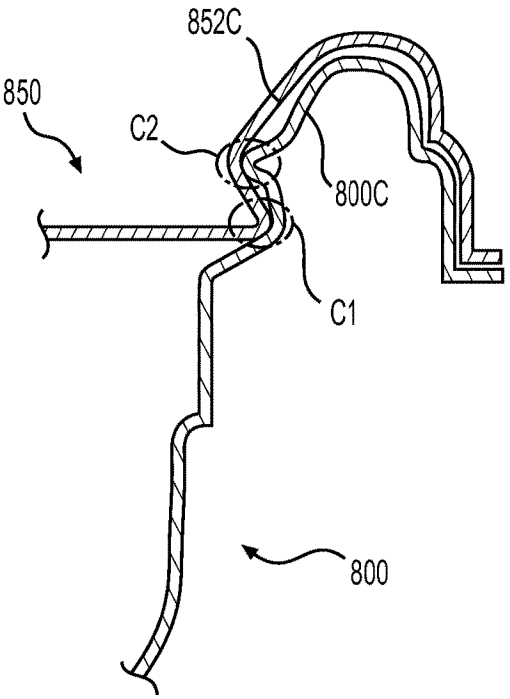
FIG. 11 is a cross-sectional view of a lid sealed to a container when viewed in the directions indicated by the lines B-B and C-C in FIGS. 10A and 10B, respectively.

FIG. 11 is a cross-sectional view of the lid 850 sealed to the container 800. More specifically, the figure shows the cross section of the part 802C of the rim of the container 800 as viewed in the direction indicated by the line C-C shown in FIG. 10B, and the cross section of the part 852C of the rim lid 850 as viewed in the direction indicated by the line B-B in FIG. 10A. Details of the areas of the parts of the rims 802C and 852C that form the seal can be seen in FIG. 11. The container 800 and the lid 850 are configured such that areas of the rim 802C of the container 800 contact areas of the rim 852C of the lid 850. Specifically, the parts of the rims 802C and 852C contact each other at the areas C1 and C2, but the other areas of the rims 802C and 852C are spaced from each other. Thus, a double seal arrangement is formed with the contact areas C1 and C2. It should be noted that the other parts of the rim of the container 800 and the other parts of the rim of the lid 850 have the same cross section as the parts 802C and 852C shown in FIG. 11.

The cross-sectional profiles of the parts of the rims 802C and 852C of the container 800 and the lid 850 are such that the lower contact area C1 is located farther from the center of the container 800 than the upper contact area C2. That is, moving upward from the lower contact area C1, the cross-sectional profiles of the parts of the rims 802C and 852C curve in a direction toward the inside of the container 800 until reaching the upper contact area C2. Moving further upward from the upper contact area C2, the cross-sectional profiles of the parts of the rims 802C and 852C curve outward, i.e., away from the center of the container 800. With this curvature, the profiles of the rims 802C and 852C are convex both above and below the upper contact area C2.

The effectiveness of the seal between the container 800 and the lid 850 is related to the interference resulting from the contact of the sealing rims at the contact areas C1 and C2. In other words, the tighter the fit of the lid 850 to the container 800 in the areas C1 and C2, the more effective the seal. Of course, the tighter this fit of the lid 850 to the container 800, the more force that is required to move the container 800 and/or lid 850 to the fully sealed position where the areas C1 and C2 contact each other. Thus, the tightness forming the seal between the lid 850 and the container 800 must be balanced against the ease with which a user can move the container 800 and/or lid 850 to the sealed positioned. With this user perspective in mind, we have found that the configuration of contact areas C1 and C2 depicted in FIG. 11 provides a highly-effective seal that can relatively easily be formed by a user. In particular, the seal depicted in FIG. 11 is resistant to leakage, and, thus, makes the container system useable, for example, as an on-the-go food storage solution. At the same time, a user will have no difficulty in moving the container 800 and/or lid 850 to the sealed position.

Figure 12B:
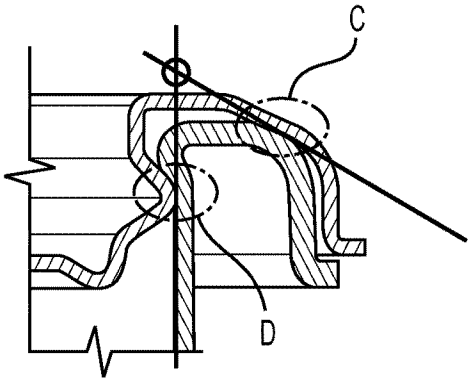
FIGS. 12A and 12B are cross-sectional views of lids engaged to comparative containers.
Figure 12A:
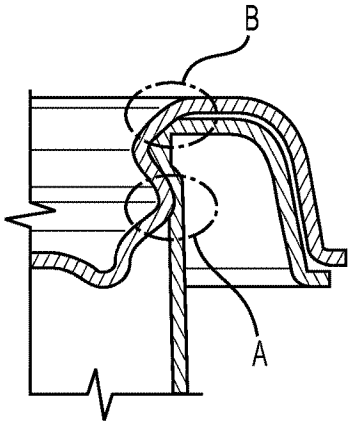

For comparison, profiles of the sealing area in the container and lid combination disclosed in the aforementioned U.S. Pat. No. 9,108,766 are shown in FIGS. 12A and 12B. Several differences between the sealing profiles shown in FIG. 11 and the sealing profiles shown in FIG. 12 are immediately apparent. For example, as shown in FIG. 11, because of the curvature of the rim 802C of the container 800 below the contact area C2, the contact areas C1 and C2 are offset in the vertical direction. Yet, both of the contact areas C1 and C2 are located on inside surfaces of the 802C of the container. In contrast, the contact areas A and B of the sealing profile shown in FIG. 12A are aligned in the vertical direction, and the contact area C of the sealing profile shown in FIG. 12B is located on an outside surface of the sealing rim of the container. Another difference is that both of the contact areas C1 and C2 are located on the lower halves of the rims 802C and 852C. In contrast, the contact area B in FIG. 12A and the contact area C in FIG. 12B are located on the upper halves of the sealing rims.

Figure 13:
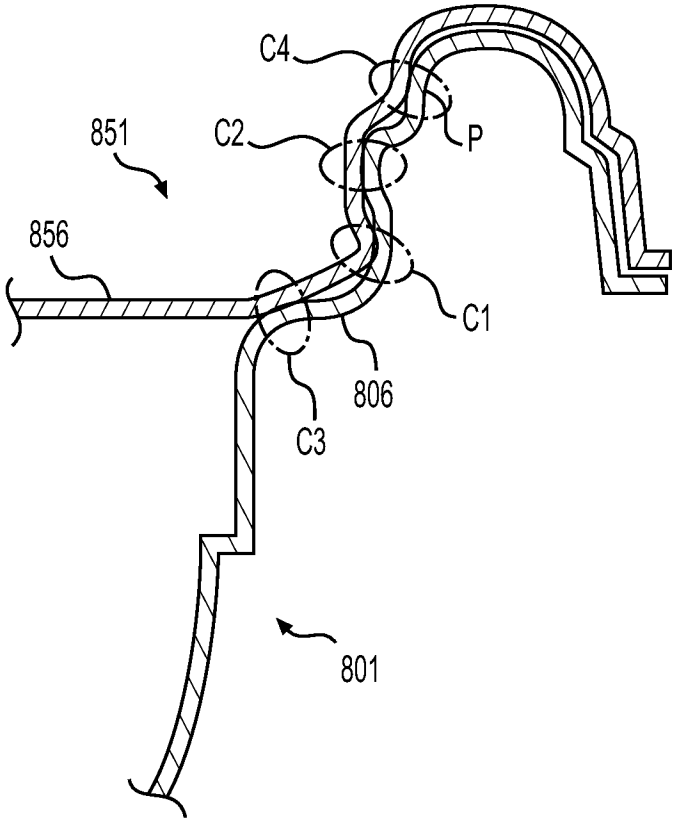
FIG. 13 is a cross-sectional view of a lid engaged to a container in a further embodiment of our invention.

FIG. 13 is a cross-sectional view of the lid 851 sealed to the container 801 in another embodiment of our invention. In this case, there are four contact areas C1, C2, C3, and C4 where the rim 805 of the container 801 contacts portions of the rim 855 of the lid 851. The contact areas C1 and C2 are at the same locations as in the embodiment depicted in FIG.

11. The contact area C3 is located below the contact areas C1 and C2, and the part of the contact area C3 of the container 801 is formed on a generally horizontal surface 806. The part of the contact area C3 of the lid 851 is formed on the generally horizontal main surface 856 that covers the open top of the container 801. The contact area C4 is located above the contact areas C1 and C2 at a point of inflection P where the rim 804 of the container 800 changes from a convex shape to a concave shape. As with the contact areas C1 and C2, both of the contact areas C3 and C4 are located on inside surfaces of the rim 804 of the container 800. The four contact areas C1-C4 of this alternative embodiment provide a strong seal that can easily be formed by a user moving the lid 851 into engagement with the container 801.

Further aspects of our invention can be seen in FIGS. 14A-14D, which show a container system including a container 900 and corresponding lid 950 for sealing the container 900. The container has a plurality of protuberances 910 formed about the outside perimeter of the rim 902. Similarly, there a plurality of protuberances 960 formed about the outside perimeter of the rim 952 of the lid 950. The protuberances 910 are sized and shaped to align with the protuberances 960 when the lid 950 is used to seal the container 900. But, in the embodiments depicted in FIGS. 14A-14D, the protuberances 910 of the container 900 do not contact the protuberances 960 of the lid 950 when the lid 950 is sealed to the container 800. In other embodiments, however, some or all of the protuberances 910 and 960 may be made to contact each other when the container systems are sealed.

The protuberances 910 and 960 provide a visual cue that the container 900 and the lid 950 correspond to each other. This can be important, for example, in situations where the container 900 and lid 950 are stored with other container systems having containers and lids with different sizes and shapes, which might lead to a user mismatching another lid with the container 900. The mismatched lid would likely not provide an effective seal. Such a situation is avoided with the container systems in embodiments of our invention because of the visual cue provided by the protuberances 910 and 960. The protuberances 910 and 960 function to provide assurance to the user that the container 900 is effectively sealed.

The protuberances 910 and 960 also provide other benefits. By being configured to align with each other, the protuberances 910 and 960 give an indication that the lid 950 is correctly positioned on the container 900. The protuberances 910 and 960 also provide tactile surfaces that aid in locating the container 900 and lid 950 by feel, for example, when the container 900 and lid 950 are set on a high shelf in a cabinet. The tactile surfaces provided by the protuberances 910 and 960 also aid in gripping the container 900 and lid 950. In this regard, in embodiments of our invention the protuberances 910 and 960 are shaped and sized to correspond to an average human finger. In further embodiments of our invention, the protuberances 910 and 960 are spaced from each other such that a human finger can fit between the protuberances 910 and the protuberances 960. Another benefit of the protuberances 910 and 960 is that they provide slots in which users can insert their fingers while handling the container 900, thereby minimizing contact between the user's fingers and surfaces of the container 900. This could be important when the container has been heated.

It should also be noted that other embodiments of our invention may have arrangements of protuberances that differ from those shown in the figures herein. For example, while the protuberances shown in the figures herein are symmetrical about the sealing rims of the containers and lids, in other embodiments the protuberances may be disposed only about certain parts of the sealing rims.

To further enhance the gripability of the container 900, a texture may be formed on the base of the container. Such texture can be added by embossing a molded container, or the texture can be formed by directly molding a pattern on the base of the container. The texture provides a user with an even more intuitive handling of the container 900.

Another notable feature of our invention is the size of the flanges 902 and 952 in which the protuberances 910 and 960 are formed in the container 900 and the lid 950. The flanges 902 and 952 are approximately 1½ to 2 times larger than flanges of at least some comparably sized containers currently offered commercially. The flanges 902 and 952 are parts of the rims of the container 900 and lid 950, and, thus, the larger flanges 902 and 952 provide additional hoop strength to the rims of the container 900 and lid 952. As discussed above, hoop strength acts to counteract forces that cause shrinkage or distortion in the sealing areas of the container and lid. The larger flanges 902 and 952 also provides a larger surface for a user to grip.

Figure 14B:
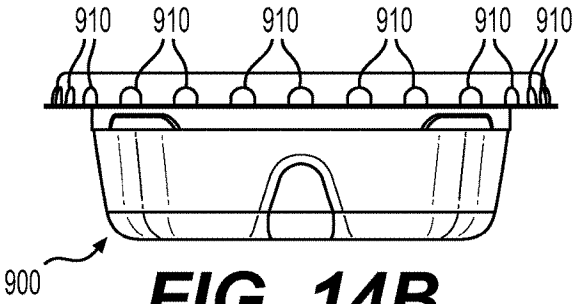
FIGS. 14A-14D are top and side views of a container and corresponding lid according to yet another embodiment of our invention.
Figure 14D:
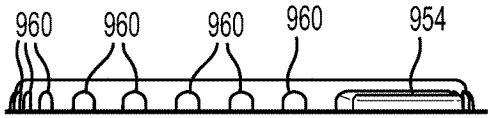
Figure 14A:
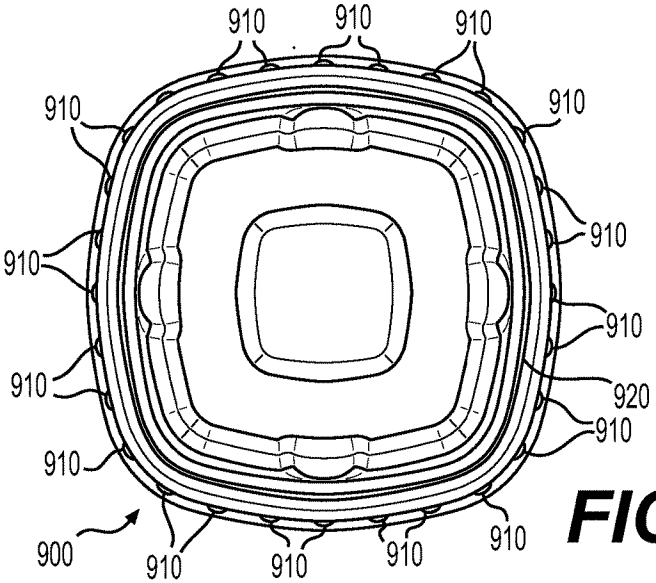
Figure 14C:
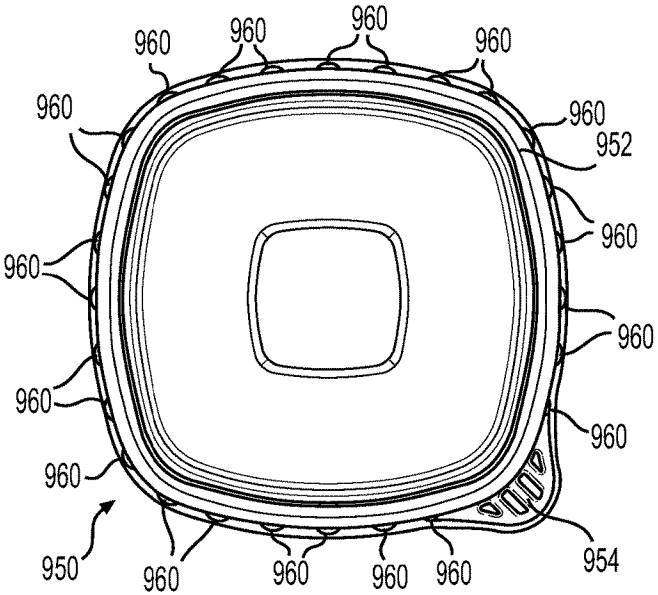

FIGS. 14C and 14D also show a tab 954 that extends from one of the corners of the lid 950. The relatively large tab 954 forms an ergonomic structure that a consumer can easily grip to remove the lid 950 from the container 900. Moreover, the large design of the tab 954 prevents lid failure by distributing an applied force over a large area.

Figure 15A:
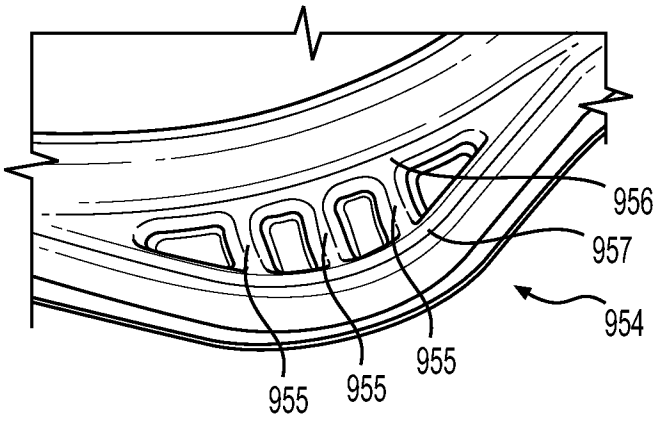
FIGS. 15A and 15B are views showing alternative embodiments of tabs for lids according to embodiments of our invention.
Figure 15B:
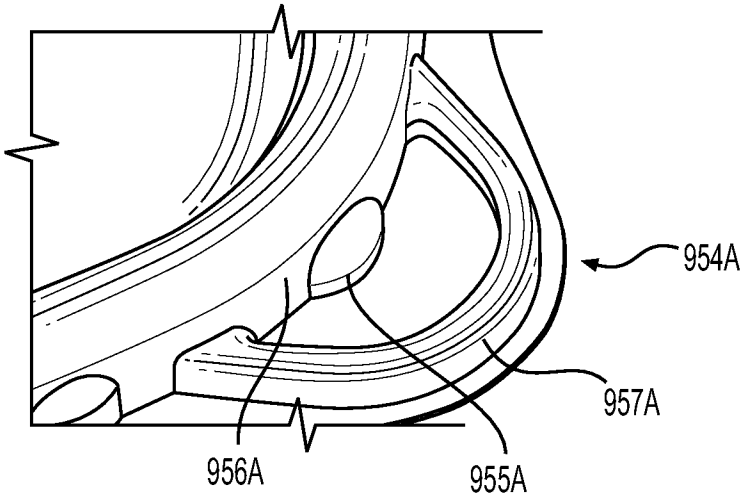

FIGS. 15A and 15B show alternative tabs for lids according to embodiments of our invention. The tab 954 shown in FIG. 15A has the same configuration as the tab shown in FIGS. 14C and 14D, while the tab 954A shown in FIG. 15B is an alternative design. The tab 954 includes a plurality of ribs 955 extending outward from the perimeter of the sealing region 956 to an outer perimeter 957 of the tab 954. The ribs 955 add strength to the tab 954. In the embodiment shown in FIG. 15B, the ribs 955A extend along the outer perimeter of the sealing region 956A, but do not extend outward to the outer perimeter 957A of the tab 954A. Also, the outer perimeter of the sealing region 956A of tab 954A has a lower profile than the outer perimeter of the sealing region 965 of tab 954. One problem that sometimes arises with a tab for the lid of a plastic container system is that the tab may invert when the tab is gripped in the process of removing the lid from the container. This inversion makes it difficult to remove the lid from the container. With the configuration of ribs 955A and outer perimeter 957A, the tab 954A may be less susceptible to such an inversion as compared to other tab configurations.

Figure 16:
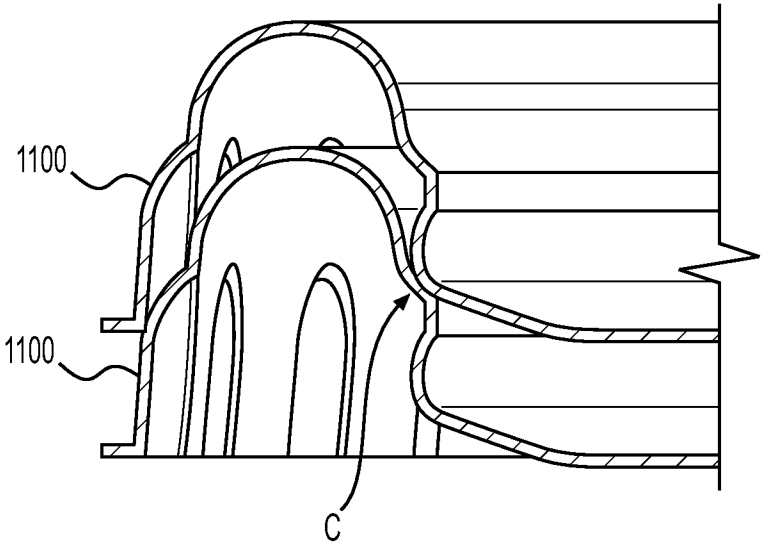
FIG. 16 is a view of two lids nesting according to an embodiment of our invention.

FIG. 16 shows how lids 1000 and 1100 according to our invention can nest together. In particular, with this configuration, the lid 1100 is cradled by the lid 1000 at the point C. The reduced space of the nested of lids 1000 and 1100 is useful when the lids are being stored.

As we discussed above, plastic storage container systems often need to be leak resistant, particularly when the systems are used for on-the-go food storage. Combinations of features of our invention provide good leak resistance. As discussed above, the rounded shapes of the rims of the containers and the lids reduce the possibility of gaps forming in the sealing areas of the container systems, both when the container systems are manufactured and as the systems are used over time. Further, the double seal configurations described herein work in conjunction with the rounded rims of the containers and lids to provide a tight seal. The result is that the container systems according to embodiments of our invention are highly functional, particularly for applications where a leak resistant seal is required.

Further, we believe that combinations of features of the container systems described herein work together synergistically to create seals that are remarkedly improved over seals in the prior art. For example, the combination of a double seal on inner surfaces the containers and lids, corresponding protuberances on the containers and the lids, and arc-shaped sides provides for an exceptionally functional sealing mechanism. Sealing mechanisms with this combination of features provide a tightness that resists leakage of contents from the containers as a result of the double seal, and it easy for the user to move the container and lid into the position that forms the seal. Moreover, the user is provided with confidence that the lid is in fact correctly positioned to the container by the alignment of the protuberances. And, the arc-shaped sides make it more likely that the seal configuration will last over repeated uses, e.g., by preventing distortions in the sealing part that can result from washing in an automatic dishwasher.

Although this invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of our invention to be determined by any claims supportable by this application and the equivalents thereof, rather than by the foregoing description.

INDUSTRIAL APPLICABILITY

The invention described herein can be used in the commercial production of plastic storage container systems. Such container systems have a wide variety of uses in homes and other locations, including the storage of food and other products.

We claim:

1. A container system comprising:

a container including a plurality of sidewalls and a rim extending from the sidewalls at a top of the container, the rim of the container including a first sealing part and a second sealing part, with the first sealing part and the second sealing part being located on surfaces of the rim that face the inside of the container, and with a plurality of protuberances being formed in the rim, the protuberances being discontinuous with each other such that each protuberance is spaced from two adjacent protuberances and each protuberance is visually distinct from other protuberances, wherein, as viewed from above the container, parts of the rim extend along arcs; and a lid for closing the top of the container, the lid having a rim that extends along sides of the lid, the rim of the lid including (i) a first sealing part that is configured to contact the first sealing part of the rim of the container to form a first sealing area, and (ii) a second sealing part that is configured to contact the second sealing part of the rim of the container to form a second sealing area, with a plurality of protuberances being formed in the lid, the protuberances being discontinuous with each other such that each protuberance is spaced from two adjacent protuberances and each protuberance is visually distinct from other protuberances, wherein, as viewed from above the lid, parts of the rim of the lid extend along arcs, wherein the protuberances of the rim of the container are positioned to align with the protuberances of the lid when the lid is sealed to the container, and wherein, when the lid is sealed to the container, each protuberance of the rim of the container is spaced from the correspondingly aligned protuberance of the lid.

2. The container system according to claim 1, wherein the first sealing area and the second sealing area are aligned in a vertical direction when the lid closes the top of the container.

3. The container system according to claim 1, wherein the rim of the container includes a first concave portion and a second concave portion, with the first sealing part of the rim of the container being located on the first concave portion and the second sealing part of the rim of the container being located between the first concave portion and the second concave portion.

4. The container system according to claim 1, wherein at least one of the parts of the rim of the container that extends along an arc has a radius that is 1.5 to 2 times longer than the length of the at least one of the parts of the rim of the container that extends along the arc, and wherein at least one of the parts of the rim of the lid that extends along an arc has a radius that is 1.5 to 2 times longer than the length of the at least one of the parts of the rim of the lid that extends along the arc.

5. A container system comprising:

a plurality of containers each having a different volume, each container including a plurality of sidewalls and a rim extending from the sidewalls at a top of the container, the rim of each container including a first sealing part and a second sealing part, with the first sealing part and the second sealing part being located on surfaces of the rim that face the inside of the container, with a plurality of protuberances being formed in the rims, the protuberances being discontinuous with each other such that each protuberance is spaced from two adjacent protuberances and each protuberance is visually distinct from other protuberances, wherein parts of the rims extend along arcs as viewed from above the containers; and a plurality of lids for closing the tops of the containers, each lid having a rim that extends along sides of the lid, the rim of the lid including (i) a first sealing part that is configured to contact the first sealing part of the rim of the container to form a first sealing area, and (ii) a second sealing part that is configured to contact the second sealing part of the rim of the container to form a second sealing area, with a plurality of protuberances being formed in each of the lids, the protuberances being discontinuous with each other such that each protuberance is spaced from two adjacent protuberances and each protuberance is visually distinct from other protuberances, wherein parts of the rims of the lids extend along arcs as viewed from above the lids, wherein the protuberances of each of the rims of the lids are positioned to align with the protuberances of at least one of the containers when the lids are sealed to corresponding containers, and wherein, when the lids are sealed to the corresponding containers, each of the protuberances of the rims of the containers is spaced from correspondingly aligned protuberances of the lids.

6. The container system according to claim 5, wherein at least one of the containers has a volume of less than 1 cup, and at least one of the arcs of the rim of the container has radius of at least about 0.25 in.

7. The container system according to claim 5, wherein at least one of the containers has a volume of between 1 to 2 cups, and at least one of the arcs of the rim of the container has radius of at least about 0.375 in.

8. The container system according to claim 5, wherein at least one of the containers has a volume of between 3 to 9 cups, and at least one of the arcs of the rim of the container has radius of at least about 0.5 in.

9. The container system according to claim 5, wherein the first sealing areas and the second sealing areas are aligned in a vertical direction when the lids close the tops of the containers.

10. The container system according to claim 5, wherein the rim of each of the containers includes a first concave portion and a second concave portion, with the first sealing part of the rim being located on the first concave portion and the second sealing part of the rim being located between the first concave portion and the second concave portion.

11. The container system according to claim 5, wherein at least one of the parts of the rims of the containers that extends along an arc has a radius that is 1.5 to 2 times longer than the length of the at least one of the parts of the rims of the containers that extends along the arc, and wherein at least one of the parts of the rims of the lids that extends along an arc has a radius that is 1.5 to 2 times longer than the length of the at least one of the parts of the rims of the lids that extends along the arc.

* * * * *